US006276411B1

(12) United States Patent
Veneziano

(10) Patent No.: US 6,276,411 B1
(45) Date of Patent: Aug. 21, 2001

(54) FUNNEL

(76) Inventor: Charles J. Veneziano, 320 Blake Dr., Ozark, AL (US) 36360

( * ) Notice: Subject to any disclaimer, the term of this patent is extended or adjusted under 35 U.S.C. 154(b) by 0 days.

(21) Appl. No.: 09/612,105

(22) Filed: Jul. 7, 2000

(51) Int. Cl.[7] ..... B67C 11/00
(52) U.S. Cl. ..... 141/337; 141/DIG. 1
(58) Field of Search ..... 141/337, 338, 141/DIG. 1

(56) References Cited

U.S. PATENT DOCUMENTS

| | | | | |
|---|---|---|---|---|
| D. 296,496 | | 7/1988 | Kang . | |
| 952,313 | * | 3/1910 | Droz | 141/337 |
| 2,100,888 | * | 11/1937 | Vine | 141/337 |
| 2,388,501 | * | 11/1945 | Shrader | 141/337 |
| 2,456,912 | * | 12/1948 | Burrows | 141/337 |
| 2,605,582 | * | 8/1952 | Allen | 141/337 |
| 3,572,318 | * | 3/1971 | Garland | 141/337 |
| 4,712,595 | | 12/1987 | Wilson . | |
| 4,825,915 | | 5/1989 | Hess et al. | 141/337 |
| 4,896,707 | | 1/1990 | Cowles | 141/337 |
| 5,078,189 | | 1/1992 | Ronsonet | 141/337 |
| 5,121,779 | | 6/1992 | Green | 141/337 |
| 5,601,230 | * | 2/1997 | Bell | 141/337 |

* cited by examiner

*Primary Examiner*—J. Casimer Jacyna

(57) ABSTRACT

A funnel for convenient storage and usage of a funnel. The funnel includes a panel. The panel has a front side, a back side, and a peripheral edge extending between the front and back sides. The panel has a hole therethrough. The hole is positioned in a medial portion of the panel. The panel has a slit therein. The slit extends from the peripheral edge to the hole. A securing means removably secures the panel to a magnetically receptive material for storage of the panel. The securing means comprises a magnetically active material. The securing means is securely attached to the back side of the panel. The slit allows the panel to be folded upon itself to form a funnel.

9 Claims, 1 Drawing Sheet

FUNNEL

BACKGROUND OF THE INVENTION

1. Field of the Invention

The present invention relates to funnel devices and more particularly pertains to a new funnel for convenient storage and usage of a funnel.

2. Description of the Prior Art

The use of funnel devices is known in the prior art. More specifically, funnel devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,121,779; U.S. Pat. No. 4,896,707; U.S. Pat. No. 5,078,189; U.S. Pat. No. 4,825,915; U.S. Pat. No. 4,712,595; and U.S. Des. Pat. No. 296,496.

While these devices fulfill their respective, particular objectives and requirements, the aforementioned patents do not disclose a new funnel. The inventive device includes a panel. The panel has a front side, a back side, and a peripheral edge extending between the front and back sides. The panel has a hole therethrough. The hole is positioned in a medial portion of the panel. The panel has a slit therein. The slit extends from the peripheral edge to the hole. A securing means removably secures the panel to a magnetically receptive material for storage of the panel. The securing means comprises a magnetically active material. The securing means is securely attached to the back side of the panel. The slit allows the panel to be folded upon itself to form a funnel.

In these respects, the funnel according to the present invention substantially departs from the conventional concepts and designs of the prior art, and in so doing provides an apparatus primarily developed for the purpose of convenient storage and usage of a funnel.

SUMMARY OF THE INVENTION

In view of the foregoing disadvantages inherent in the known types of funnel devices now present in the prior art, the present invention provides a new funnel construction wherein the same can be utilized for convenient storage and usage of a funnel.

The general purpose of the present invention, which will be described subsequently in greater detail, is to provide a new funnel apparatus and method which has many of the advantages of the funnel devices mentioned heretofore and many novel features that result in a new funnel which is not anticipated, rendered obvious, suggested, or even implied by any of the prior art funnel devices, either alone or in any combination thereof.

To attain this, the present invention generally comprises a panel. The panel has a front side, a back side, and a peripheral edge extending between the front and back sides. The panel has a hole therethrough. The hole is positioned in a medial portion of the panel. The panel has a slit therein. The slit extends from the peripheral edge to the hole. A securing means removably secures the panel to a magnetically receptive material for storage of the panel. The securing means comprises a magnetically active material. The securing means is securely attached to the back side of the panel. The slit allows the panel to be folded upon itself to form a funnel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new funnel apparatus and method which has many of the advantages of the funnel devices mentioned heretofore and many novel features that result in a new funnel which is not anticipated, rendered obvious, suggested, or even implied by any of the prior art funnel devices, either alone or in any combination thereof.

It is another object of the present invention to provide a new funnel which may be easily and efficiently manufactured and marketed.

It is a further object of the present invention to provide a new funnel which is of a durable and reliable construction.

An even further object of the present invention is to provide a new funnel which is susceptible of a low cost of manufacture with regard to both materials and labor, and which accordingly is then susceptible of low prices of sale to the consuming public, thereby making such funnel economically available to the buying public.

Still yet another object of the present invention is to provide a new funnel which provides in the apparatuses and methods of the prior art some of the advantages thereof, while simultaneously overcoming some of the disadvantages normally associated therewith.

Still another object of the present invention is to provide a new funnel for convenient storage and usage of a funnel.

Yet another object of the present invention is to provide a new funnel which includes a panel. The panel has a front side, a back side, and a peripheral edge extending between the front and back sides. The panel has a hole therethrough. The hole is positioned in a medial portion of the panel. The panel has a slit therein. The slit extends from the peripheral edge to the hole. A securing means removably secures the panel to a magnetically receptive material for storage of the panel. The securing means comprises a magnetically active material. The securing means is securely attached to the back side of the panel. The slit allows the panel to be folded upon itself to form a funnel.

Still yet another object of the present invention is to provide a new funnel that is a panel having a magnetic coating thereon for easy storage of the device against a magnetically receptive material such as the outside surface of a refrigerator.

Even still another object of the present invention is to provide a new funnel that may be unfolded to form a generally planar panel for easy cleaning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
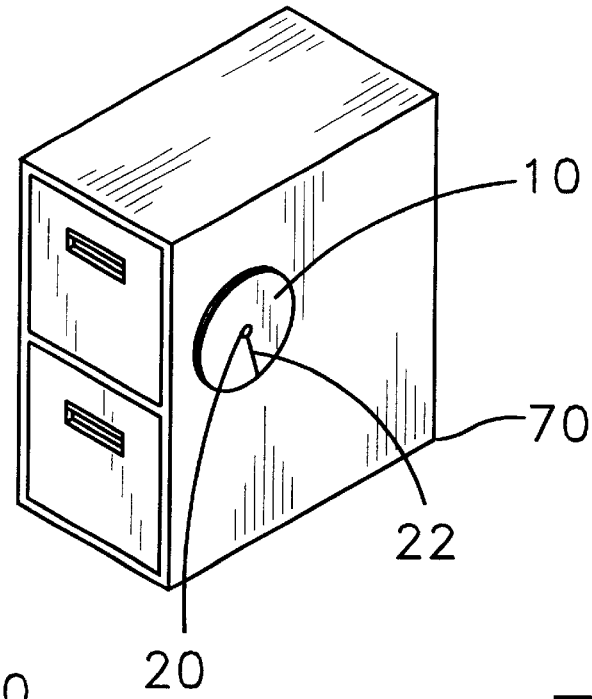
FIG. 1 is a schematic perspective in use view of a new funnel according to the present invention.
Figure 2:
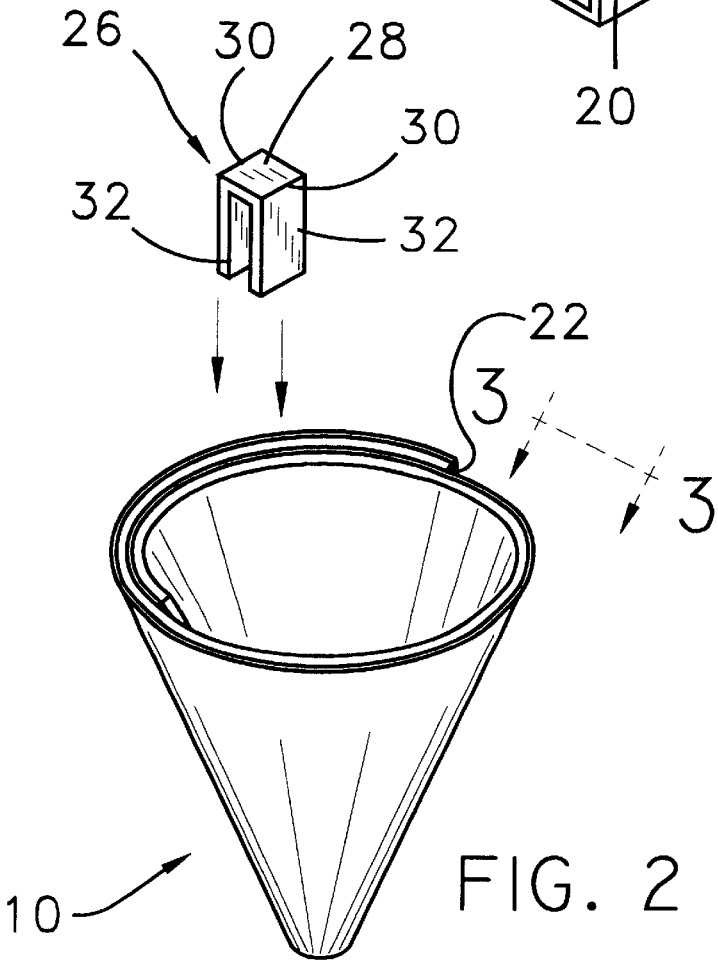
FIG. 2 is a schematic perspective view of the present invention.
Figure 3:
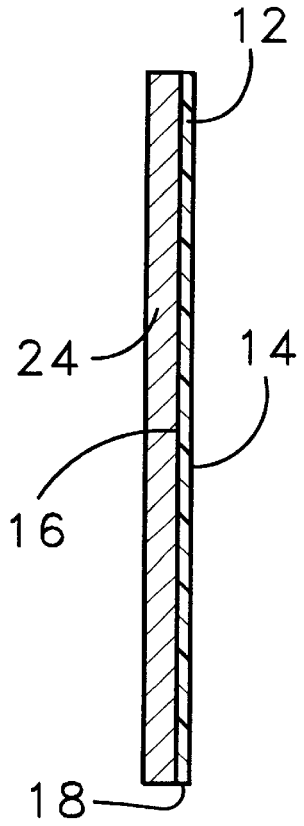
FIG. 3 is a schematic side cross-sectional view taken along line 3—3 of the present invention.

With reference now to the drawings, and in particular to FIGS. 1 through 3 thereof, a new funnel embodying the principles and concepts of the present invention and generally designated by the reference numeral 10 will be described.

As best illustrated in FIGS. 1 through 3, the funnel 10 generally comprises a panel 12. The panel 12 has a front side 14, a back side 16, and a peripheral edge 18 extending between the front and back sides. The panel 10 has a hole 20 therethrough. The hole 20 is positioned in a medial portion of the panel 12. The panel 12 has a slit 22 therein. The slit 22 extends from the peripheral edge 18 to the hole 20. The panel 12 comprises a generally flexible material. The generally flexible material preferably comprises a plastic material. Ideally, vinyl is the plastic material. The panel 12 has a generally circular shape. The panel 12 preferably has a diameter length generally between 6 inches and 10 inches. Preferably, the peripheral edge 18 has a height generally between 1/16 inch and ½ inch.

A securing means 24 removably secures the panel 12 to magnetically receptive material as is conventionally found on the outer body of refrigerators and metal cabinets 70. The securing means 24 comprises a magnetically active material. The back side 16 of the panel 12 is coated with the magnetically active material. The magnetically active material is generally flexible and comprises conventional magnetic material used for flexible refrigerator magnets.

A fastening means 26 retains the panel 12 in a funnel shape as shown in FIG. 2. The fastening means 26 comprises a base 28 portion. The base portion has a pair of ends 30. Each of a pair of legs 32 is integrally coupled to and extends perpendicularly away from one of the ends 30 of the base portion 28. The fastening means 26 is generally U-shaped. The fastening means 26 comprises a substantially rigid material. The base portion 28 preferably has a length generally equal to less than twice the height of the peripheral edge 18 and securing means 24. This allows the fastening means to act as a clip between two portions of adjacently positioned peripheral edge 18.

In use, the panel 12 is wrapped about the hole to define a funnel shape such that the fastening means 26 may be positioned over two adjacent portions of the peripheral edge 18 to selectively hold the panel 12 in the funnel shape. When not in use, the panel 12 is conveniently stored against a cabinet 70 or refrigerator.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A funnel device, said funnel device being removably attachable to a magnetically receptive material, said device comprising:

a panel, said panel having a front side, a back side, and a peripheral edge extending between said front and back sides, said panel having a hole therethrough, said hole being positioned in a medial portion of said panel, said panel having a slit therein, said slit extending from said peripheral edge to said hole; and a securing means for removably securing said panel to said magnetically receptive material, said securing means comprising a magnetically active material, said securing means being securely attached to said back side of said panel.

2. The funnel device as in claim 1, wherein said panel further comprises:

said panel comprising a generally flexible material, said generally flexible material comprising a plastic material.

3. The funnel device as in claim 2, wherein said panel further comprises:

said panel having a generally circular shape, said panel having a diameter length generally between 6 inches and 10 inches, said peripheral edge having a height generally between ⅛ inch and ½ inch.

4. The funnel device as in claim 3, further comprising:

a fastening means for retaining said panel in a funnel shape.

5. The funnel device as in claim 1, wherein said panel further comprises:

said panel having a generally circular shape, said panel having a diameter length generally between 6 inches and 10 inches, said peripheral edge having a height generally between ⅛ inch and ½ inch.

6. The funnel device as in claim 1, wherein said securing means further comprises:

said back side of said panel being coated with said magnetically active material, said magnetically active material being generally flexible.

7. The funnel device as in claim 1, further comprising:

a fastening means for retaining said panel in a funnel shape.

8. The funnel device as in claim 7, wherein said fastening means further comprises:

said fastening means comprising a base portion, said base portion having a pair of ends, each of a pair of legs being integrally coupled to and extending perpendicularly away from one of said ends of said base portion, said fastening means being generally U-shaped, said fastening means comprising a substantially rigid material.

9. A funnel device, said funnel device being removably attachable to a magnetically receptive material, said device comprising:

a panel, said panel having a front side, a back side, and a peripheral edge extending between said front and back sides, said panel having a hole therethrough, said hole being positioned in a medial portion of said panel, said panel having a slit therein, said slit extending from said peripheral edge to said hole, panel comprising a generally flexible material, said generally flexible material comprising a plastic material, said panel having a generally circular shape, said panel having a diameter length generally between 6 inches and 10 inches, said peripheral edge having a height generally between ⅛ inch and ½ inch;

a securing means for removably securing said panel to said magnetically receptive material, said securing means comprising a magnetically active material, said back side of said panel being coated with said magnetically active material, said magnetically active material being generally flexible;

a fastening means for retaining said panel in a funnel shape, said fastening means comprising a base portion, said base portion having a pair of ends, each of a pair of legs being integrally coupled to and extending perpendicularly away from one of said ends of said base portion, said fastening means being generally U-shaped, said fastening means comprising a substantially rigid material, said base portion having a length generally equal to less than twice the height of said peripheral edge and said securing means; and wherein said panel is wrapped about said hole to define a funnel shape such that said fastening means may be positioned over two adjacent portions of said peripheral edge to selectively hold said panel in said funnel shape.

* * * * *